United States Patent [19]

Aakre et al.

[11] Patent Number: 4,946,163

[45] Date of Patent: Aug. 7, 1990

[54] PORTABLE BASKETBALL BACKBOARD ASSEMBLY

[76] Inventors: Stewart C. Aakre, Rural Route 3, Hawley, Minn. 56549; William A. Fulcher, P.O. Box 657, Sandia Park, N. Mex. 87047; Gary L. Johnson, 12200 Ranchitos Rd., NE., Albuquerque, N. Mex. 87122

[21] Appl. No.: 336,202

[22] Filed: Apr. 10, 1989

[51] Int. Cl.[5] ..... A63B 63/08

[52] U.S. Cl. ..... 273/1.5 R

[58] Field of Search ..... 273/1.5 R, 1.5 A, 411; 248/462

[56] References Cited

U.S. PATENT DOCUMENTS

| | | | |
|---|---|---|---|
| 2,046,134 | 6/1936 | Ryang | 248/462 X |
| 2,144,148 | 1/1939 | Gross | 273/1.5 R |
| 2,872,192 | 2/1959 | Margetts et al. | 273/1.5 R |
| 2,961,236 | 11/1960 | Murphy | 273/1.5 R |
| 3,288,413 | 11/1966 | Gregory | 273/411 X |
| 3,329,427 | 7/1967 | Bearson | 273/1.5 R |
| 3,341,197 | 9/1967 | Bottorff | 273/1.5 R |
| 3,427,025 | 2/1969 | Proctor | 273/1.5 R |
| 3,650,530 | 3/1972 | Gantz | 273/1.5 R X |
| 3,820,784 | 6/1974 | Boitano et al. | 273/1.5 R |
| 4,869,501 | 9/1989 | Anastasakis | 273/1.5 R |

FOREIGN PATENT DOCUMENTS

| | | | |
|---|---|---|---|
| 620505 | 7/1958 | Canada | 273/1.5 R |

*Primary Examiner*—Paul E. Shapiro

*Attorney, Agent, or Firm*—William A. Eklund

[57] ABSTRACT

A portable, foldable basketball backboard assembly is disclosed. In an upright deployed position the assembly is erected to provide a regulation size basketball backboard. The assembly may be folded into a compact assembly sized for storage and transportation. In the folded position the assembly is transportable on integral wheel assemblies. The assembly includes an integral spring biasing mechanism to assist in raising the assembly to the upright position.

10 Claims, 10 Drawing Sheets

PORTABLE BASKETBALL BACKBOARD ASSEMBLY

BACKGROUND OF THE INVENTION

1. Field of the Invention

The present invention is generally related to basketball backboards, goals and supporting structures. More particularly, the present invention is related to foldable and transportable basketball backboards.

2. Related Art

Conventional basketball backboards are typically mounted on a fixed pole or other fixed object. The vibration and impact to which a basketball backboard is subjected ordinarily mandates that a pole on which the backboard is mounted be securely set in concrete. The cost and difficulty of setting a pole in concrete is sufficiently great to deter many casual basketball players from installing a backboard. Moreover, permanently installed backboards are not infrequently considered inappropriate for some locations, or are inconsistent with other uses required of some locations.

Portable basketball backboards have been previously available. Such backboards are typically mounted on wheeled frames or other devices, such that the backboard can be wheeled from one place to another. Although such portable backboards can indeed be moved from location to another, they are generally large and unwieldy, and are not easily stored or transported more than short distances without considerable difficulty.

In gymnasiums, basketball backboards are commonly suspended from the ceiling on swingable structures which permit the backboard to be swung upwardly and out of the way, so as to permit the gymnasium to be used for other activities with which a conventional fixed basketball backboard would interfere. Although this approach is suitable for a gymnasium, it does not meet the needs of the casual basketball player who might wish to occasionally play basketball at other locations.

Accordingly, the object and purpose of the present invention is to provide a portable and collapsible basketball backboard which can be temporarily installed at any desired location, and which can be compactly folded for ease of both transportation and storage.

SUMMARY OF THE INVENTION

In accordance with the present invention, there is provided a portable, collapsible basketball backboard assembly. The assembly includes a generally flat base. Extending from the front edge of the base is a flat stabilizer means which serves to stabilize the assembly when it is in an upright deployed position for play, which is described further below.

Extending upwardly from the front edge of the base is a support arm means which is hinged at its lower end to the front edge of the base, and which is hinged at its upper end to the lower end of a goal post. In the upright position the support arm means supports the goal post in a substantially vertical position. The goal post supports a basketball backboard and hoop. In the preferred embodiment the height of the backboard on the goal post is adjustable.

A bracing lift arm is hinged to the rear edge of the base and extends upwardly to an intermediate point on the goal post, where it is hinged to the goal post. The bracing lift arm is preferably spring biased toward the upright position.

In the preferred embodiment there are further provided a pair of mounting plates which extend upwardly from the rear edge of the base. Swiveling caster wheel assemblies extend rearwardly from the mounting plates. When the goal post, bracing lift arm, and support arm means are folded downward into the collapsed position, the entire assembly can be tilted onto the caster wheel assemblies for transport.

These and other aspects of the present invention will be more apparent from the accompanying drawings and the following detailed description of the invention.

BRIEF DESCRIPTION OF THE DRAWINGS

The accompanying drawings form a part of and are incorporated into this specification. In the drawings.

DETAILED DESCRIPTION OF THE PREFERRED EMBODIMENT

Figure 1:
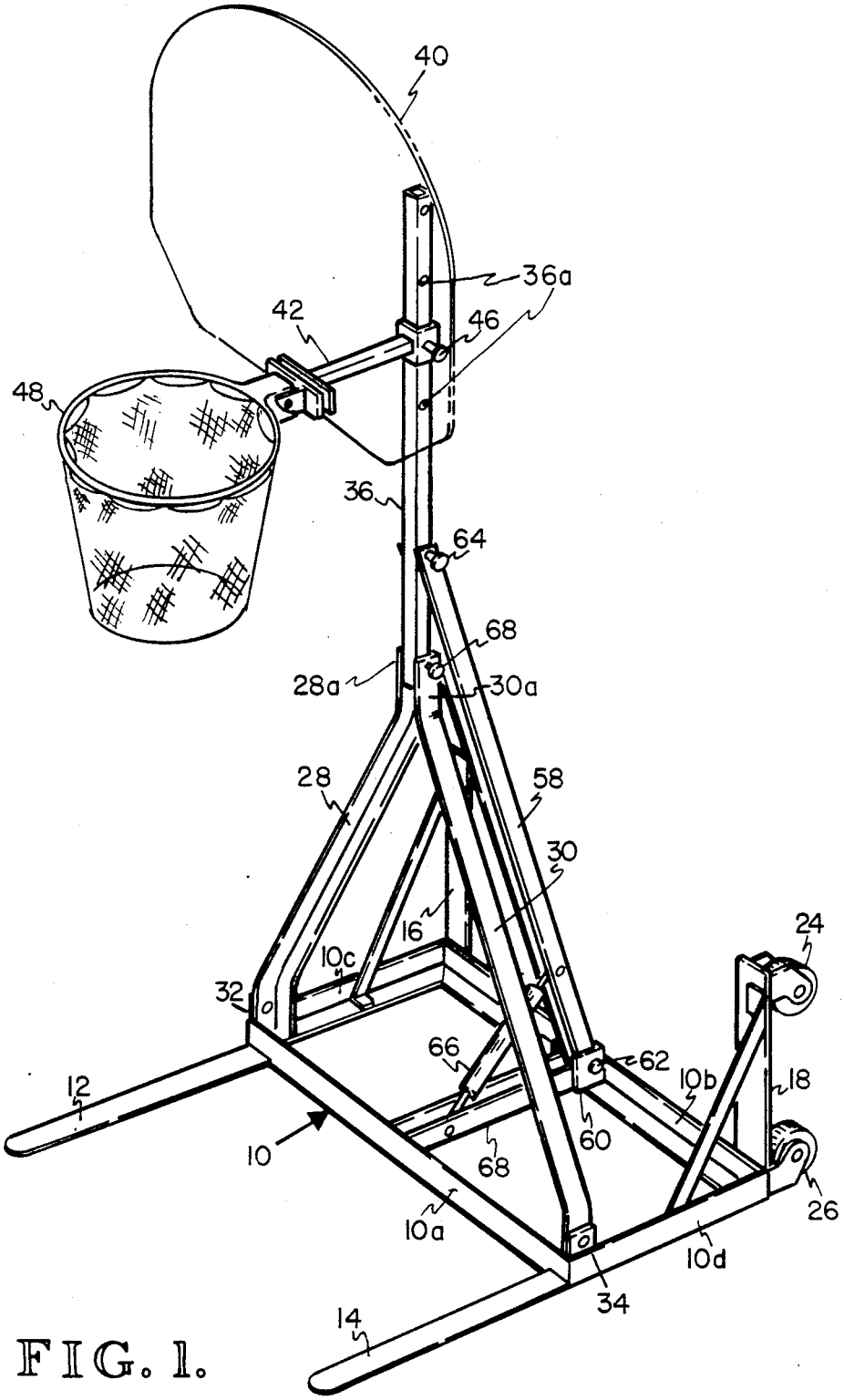
FIG. 1 is an isometric view of the preferred embodiment of the backboard assembly of the present invention, in the upright deployed position.
Figure 2:
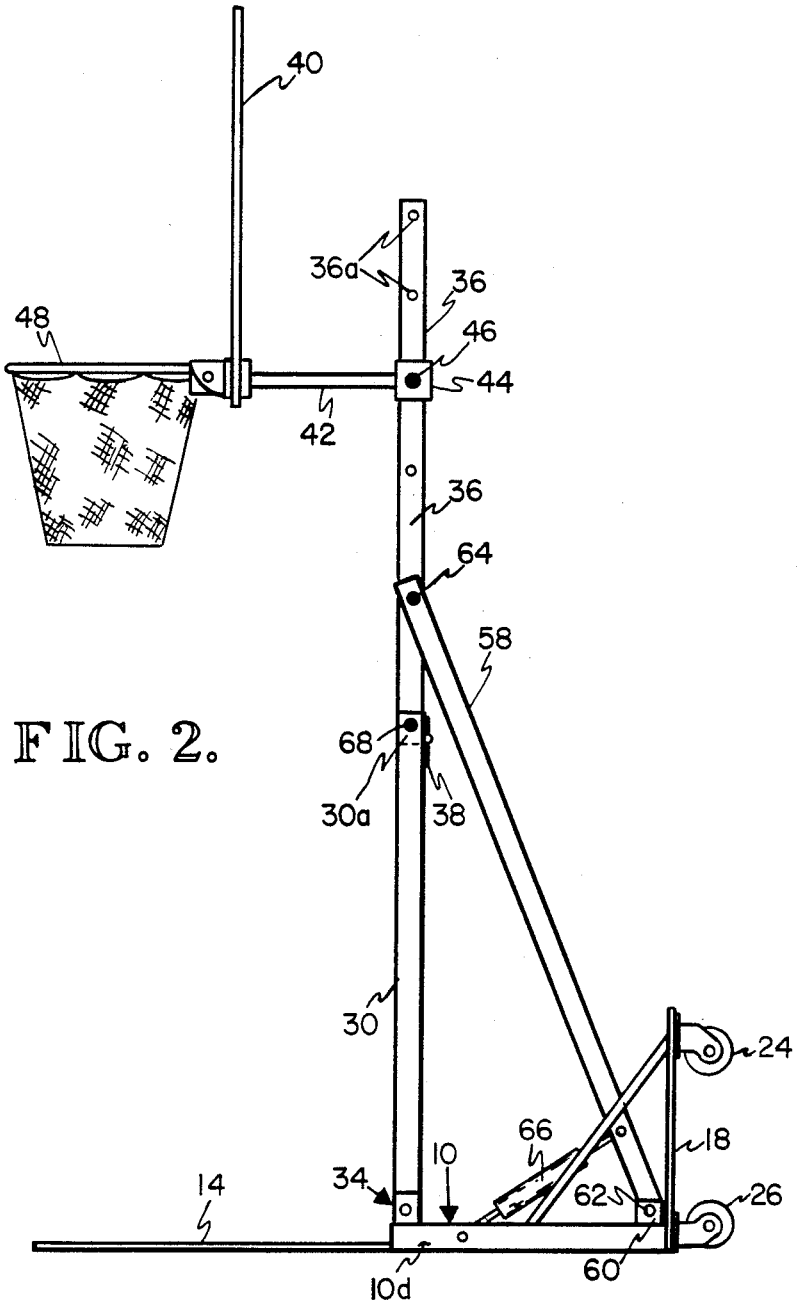
FIG. 2 is a side view of the assembly shown in FIG. 1.
Figure 3:
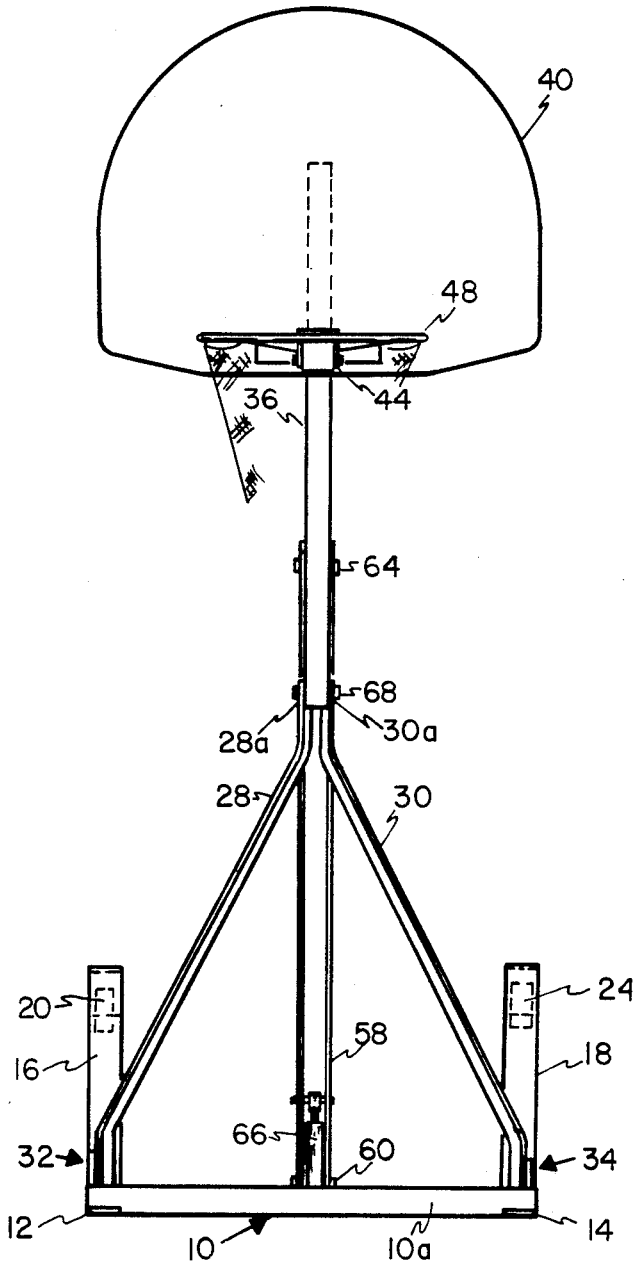
FIG. 3 is a front view of the assembly shown in FIG. 1.
Figure 4:
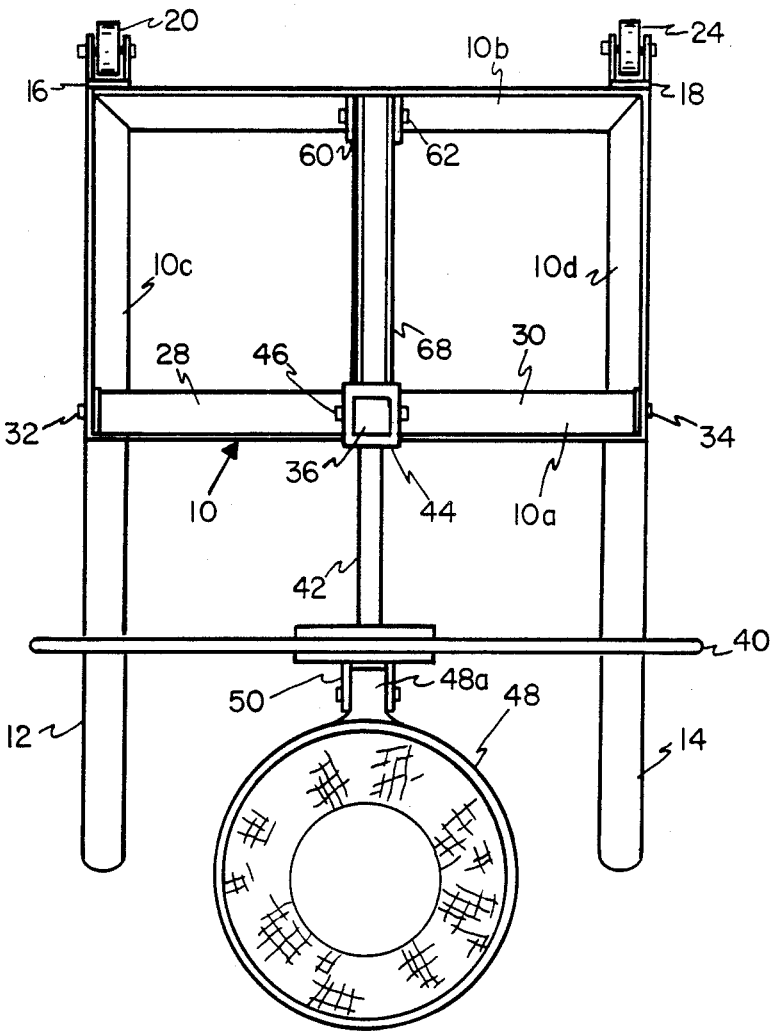
FIG. 4 is a top view of the assembly shown in FIG. 1.
Figure 5:
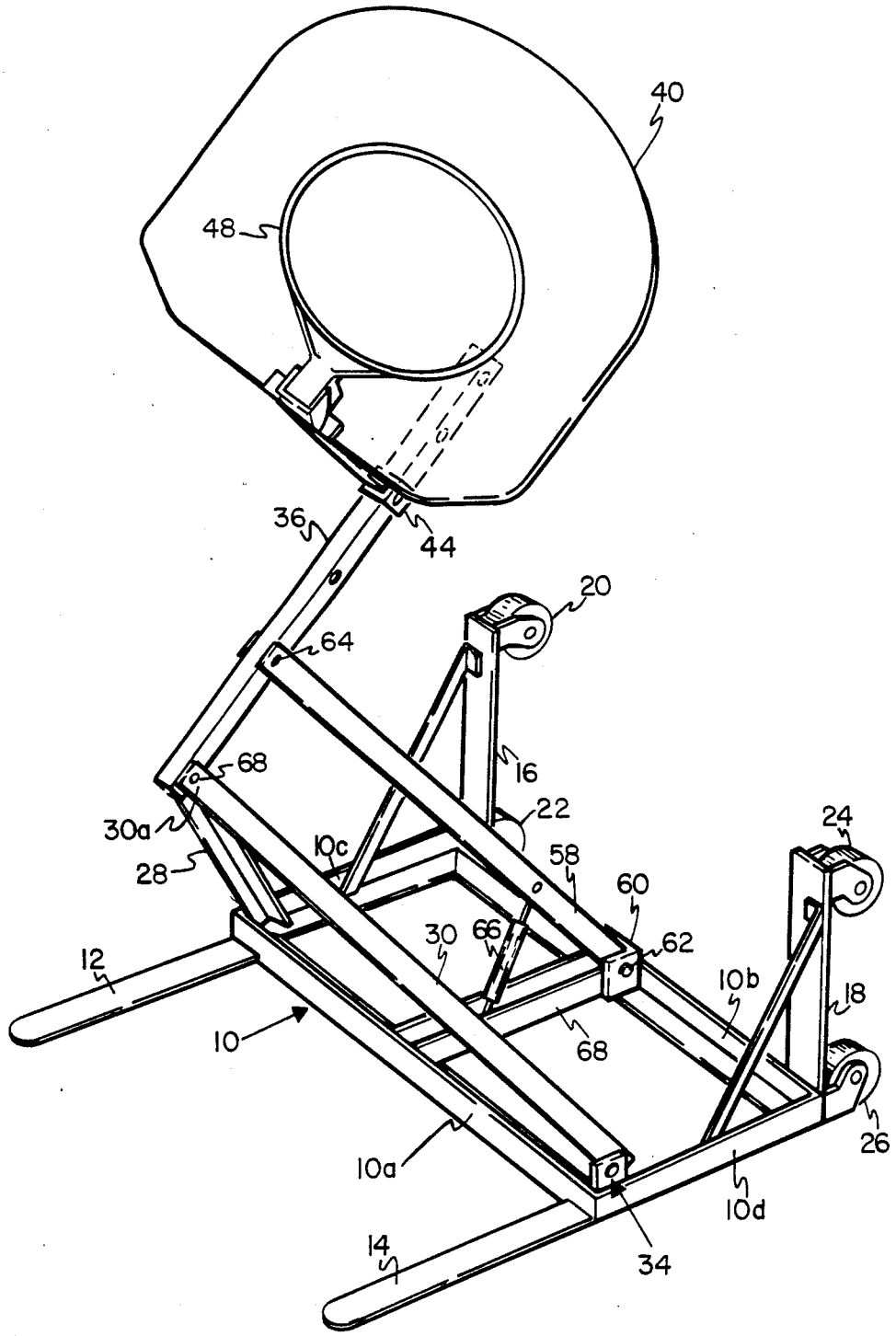
FIG. 5 is an isometric view of the assembly of FIG. 1, being folded into the collapsed position.

Referring first to FIGS. 1 through 8, there is illustrated a preferred embodiment of the backboard assembly of the present invention. The assembly is shown in an upright deployed position in FIGS. 1 through 4, and in a folded position in FIGS. 6 and 7. FIG. 5 shows the assembly in an intermediate position between the two extremes, as occurs either when the assembly is being raised to the upright position or being lowered to the folded position.

In the following description all references to orientations and directions are with respect to the assembly in the upright, or deployed position, as shown in FIGS. 1 through 4, except where specifically stated to be otherwise.

Referring first to FIGS. 1 through 4, the assembly includes a planar, rectangular base 10 which rests flat on the ground or other playing surface when the assembly is in the upright, or deployed, position illustrated. The base 10 as shown is formed of angle iron, although in other embodiments it may be formed of tubular steel or aluminum stock, or light weight polymeric stock. The base 10 includes a front edge member 10*a*, a rear edge member 10*b*, and parallel side members 10*c* and 10*d*. In the deployed position, the front edge member 10*a* is positioned adjacent to and facing the basketball court, and extends approximately along the boundary of the court.

A pair of flat stabilizer arms 12 and 14 extend forward horizontally from the opposite ends of the front edge member 10*a*. The stabilizer arms 12 and 14 are parallel to one another and also extend parallel to the plane of the base 10, and extend perpendicular to the front edge member 10*a*. The stabilizer arms 12 and 14 operate to stabilize the assembly against tipping when it is in the upright deployed position, as described further below.

A pair of elongate mounting plates 16 and 18 extend upwardly from the opposite ends of the rear edge member 10*b*, perpendicular to the plane of the base 10 and also perpendicular to both the rear edge member 10*b* and the side edge members 10*c* and 10*d*. Affixed to the upper and lower ends respectively of the mounting plate 16 and extending rearwardly therefrom are a pair of swiveling caster wheel assemblies 20 and 22. Likewise, affixed to the upper and lower ends respectively of mounting plate 18 and extending rearwardly therefrom are a pair of swiveling caster wheel assemblies 24 and 26. As discussed further below, the caster wheel assemblies 20, 22, 24 and 26 extend rearwardly and out of the way when the assembly is deployed for use, but support the assembly for transport when it is collapsed and tilted onto the caster wheel assemblies.

Figure 6:
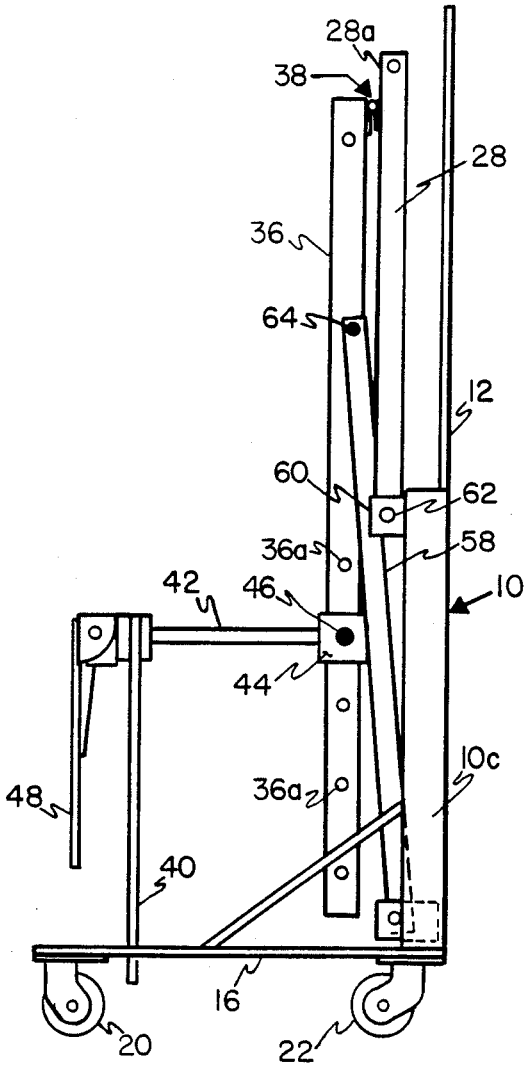
FIG. 6 is a side view of the assembly of FIG. 1 fully collapsed, tilted onto the caster wheel assemblies, and prepared for transport and storage.

A pair of angle iron support arms 28 and 30 extend upwardly and inwardly from the opposite ends of the front edge member 10*a* of the base 10. The lower ends of the support arms 28 and 30 are pivotably attached to the forward corners of the base 10 by means of pivot pin assemblies 32 and 34. The upper ends of the support arms 28 and 30 join together and support a vertical goal post 36 which extends upwardly from and rests upon the ends of the support arms 28 and 30. The lower end of the goal post 36 is hinged for relative swinging motion to the upper ends of the support arms 28 and 30 by means of a hinge 38 (FIG. 6, for example).

The goal post 36 supports a backboard 40. The backboard 40 extends from and is mounted upon a support arm 42 which extends outwardly from the goal post 36 and is affixed to the goal post 36 by means of a square tubular mounting sleeve 44. The goal post 36 includes a number of horizontal bores 36*a* spaced along its length, by which the height of the backboard 40 can be adjusted and fixed by means of a locating pin 46 which passes through aligned holes in the mounting sleeve 44 and the bores 36*a* in the goal post 36. In this manner the height of the backboard 40 can be adjusted to meet the needs of basketball players of all ages and skill levels.

Attached to the backboard is a foldable hoop 48. Referring to FIG. 8, the hoop 48 includes an integral rectangular bracket 48*a* that is enclosed between a pair of ears 50 which extend from the backboard 40. The bracket 48*a* is attached to the ears 50 by a pivot pin 52 which passes through a bore in the bracket 48*a* as well as the aligned holes in the ears 50. The pivot pin 52 allows the hoop 48 to swing upwardly from the ordinary horizontal position. In the upright position shown in FIGS. 1 through 4, the hoop 48 is locked into the horizontal position by a locking pin 54 which passes through aligned holes in the ears 50 and the bracket 48*a*. When the locking pin 54 is removed, the hoop 48 can be swung upwardly against the face of the backboard 40 for storage, in the position shown in FIGS. 6 and 7.

The goal post 36 is stabilized by means of a bracing lift arm 58 formed of channel iron. The bracing lift arm 58 is connected at its lower end to a bracket 60 affixed to the rear edge member 10*b* of the base 10. The lower end of the bracing lift arm 50 is connected to the bracket 60 by means of a pivot pin 62 which allows the lift arm 58 to swing in a vertical plane about the rear edge member 10*b*. The upper end of the lift arm 58 is connected to an intermediate point on the goal post 36 by means of an upper pivot pin 64.

The bracing lift arm 58 is pivotably connected near its lower end to one end of a damped compression spring assembly 66. The damped compression spring assembly 66 is pivotably connected at its lower, opposite end to a horizontal cross member 68 which extends between the front and rear edge members 10*a* and 10*b* of the base 10. The compression spring assembly 66 is maintained in compression so as to urge the bracing lift arm 58 toward the upright position, thereby assisting in the raising of the lift arm 58 from the folded position to the upright deployed position.

In the upright deployed position shown in FIGS. 1 through 4, the goal post 36 is locked into a vertical position, extending directly above the support arms 28 and 30, by means of a locking pin 68. The locking pin 68 passes through a bore in the lower end of the goal post 36, which bore is aligned with bores in a pair of integral ears 28*a* and 30*a* that extend from the upper ends of the support arms 28 and 30 alongside the sides of the goal post 36. In this position, the locking pin 68 locks the goal post 36 into a vertical position, preventing the post 36 from rotating about the hinge 38, and the spring assembly 66 serves to further maintain the goal post 36 in this position. Further, in the assembled position the goal post 36 is stabilized by the stabilizer arms 12 and 14.

Figure 7:
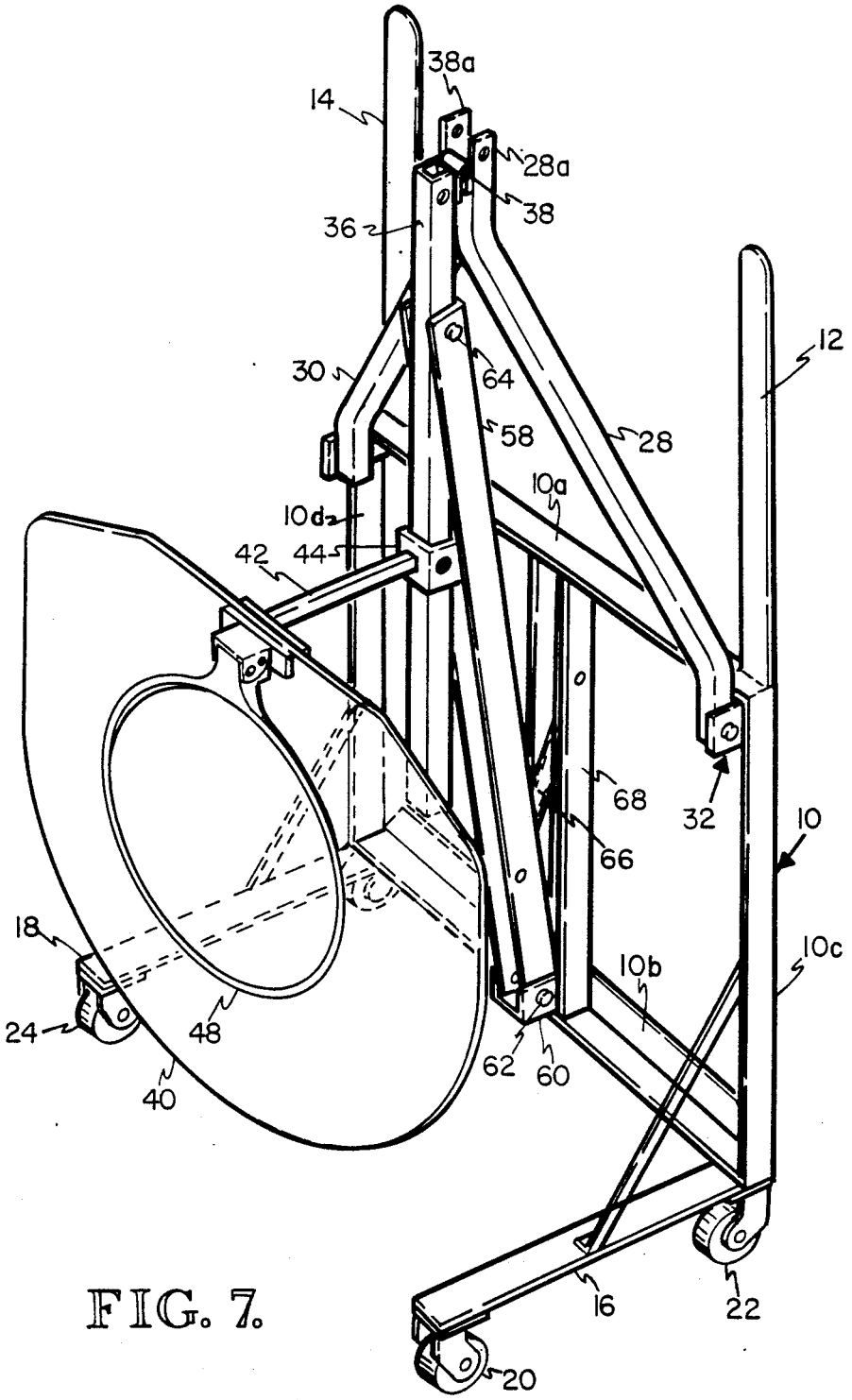
FIG. 7 is an isometric view of the collapsed assembly of FIG. 6.
Figure 8:
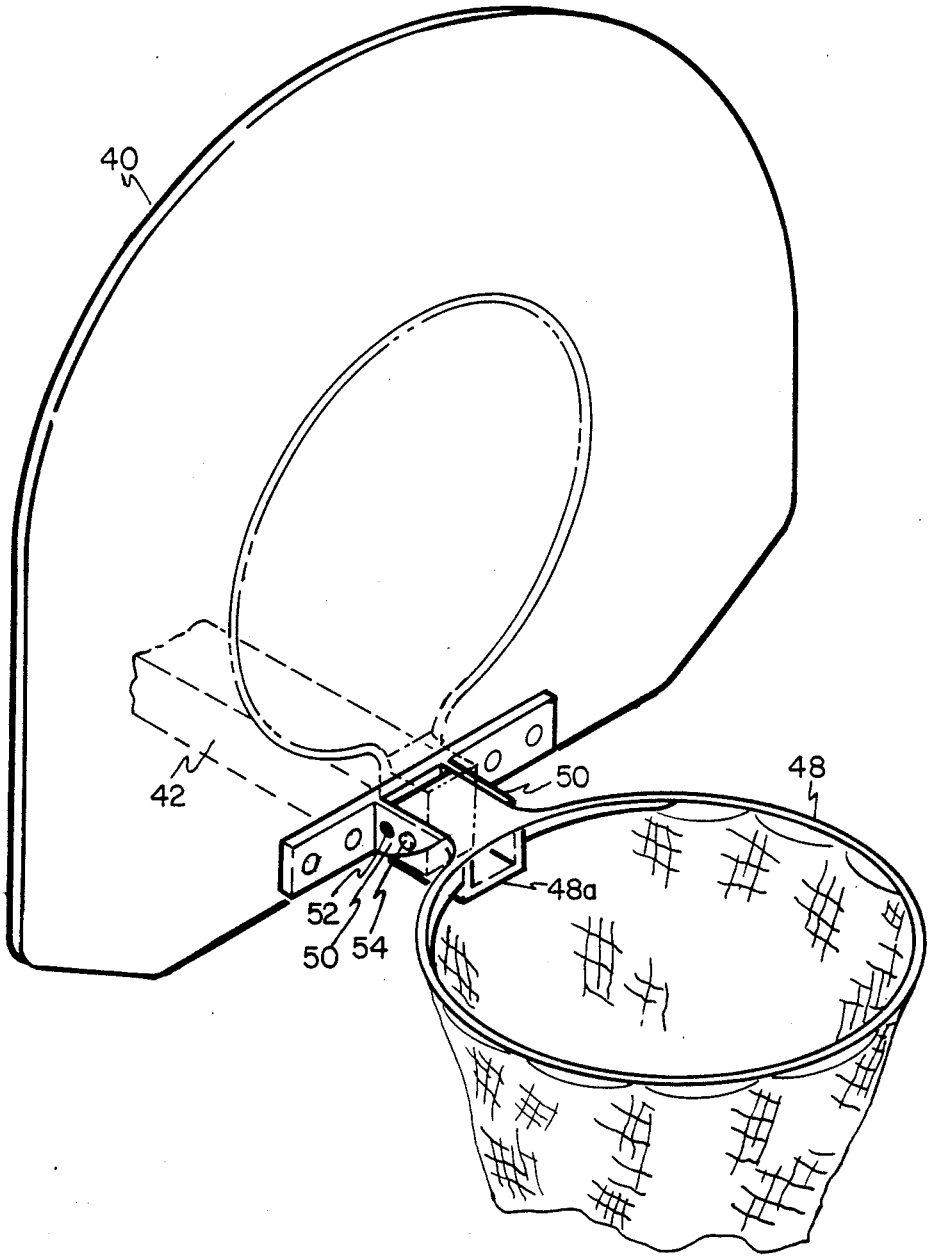
FIG. 8 is a partial enlarged view showing the details of the basketball backboard and hoop.

Referring now to FIGS. 5 through 7, the upright backboard assembly is folded for storage by withdrawing the locking pin 68 and folding the goal post 36 and backboard 40 backward and downward toward the base 10. In so folding, the support arms 28 and 30 fold downwardly until they are approximately parallel to and adjacent to the stabilizer arms 12 and 4, as shown in FIGS. 6 and 7. The hoop 48 may then be folded against the backboard 40, and the entire assembly may be tilted upwardly until it rests on the swiveled caster wheels 20–26, as shown in FIGS. 6 and 7. It will be appreciated that the folded assembly is small enough to be easily transported and stored.

Figure 9:
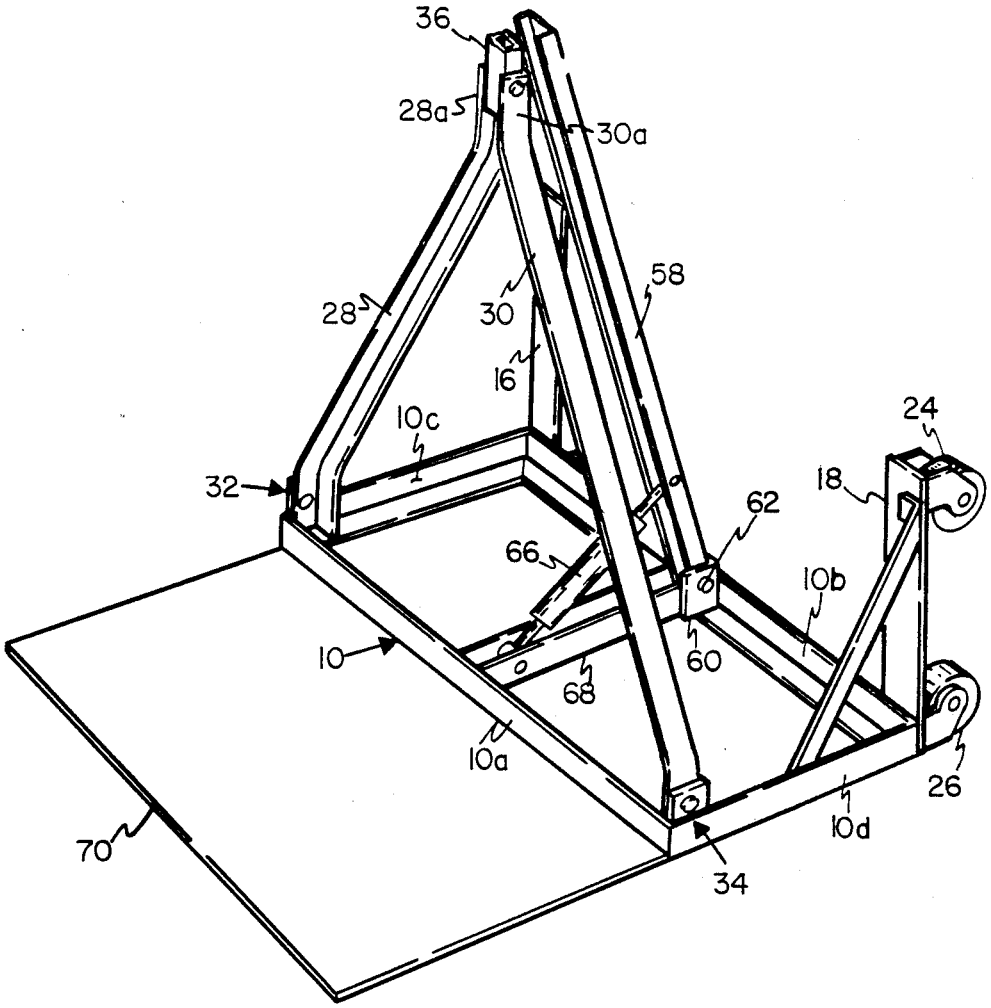
FIG. 9 is a partial isometric view of a first alternative embodiment of the invention.

An alternative embodiment is shown in FIG. 9. It will be appreciated that the elements of the alternative embodiment which are the same as the corresponding elements in the preferred embodiment shown in FIGS. 1 through 8 are identically numbered. The difference between the embodiment shown in FIGS. 1 through 8 and the embodiment shown in FIG. 9 is that the alternative embodiment shown in FIG. 9 has a flat stabilizer plate 70, instead of the flat stabilizer arms 12 and 14.

Figure 10:
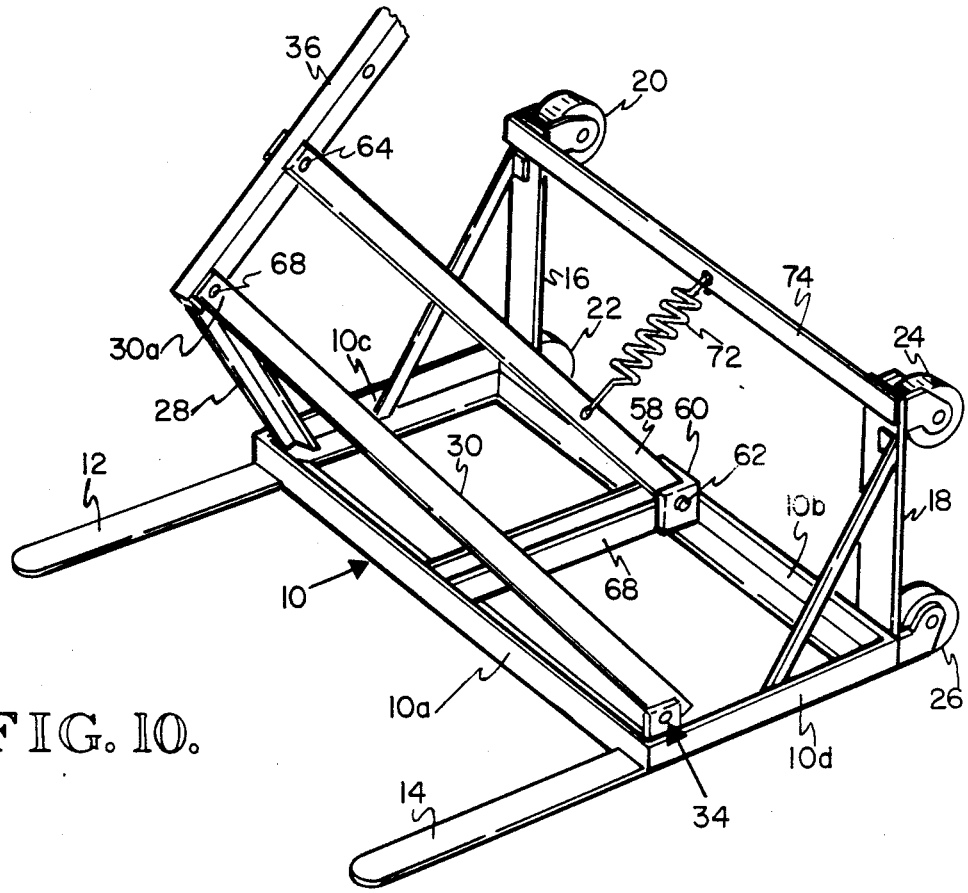
FIG. 10 is a second alternative embodiment having a tension spring which assists in raising the assembly to the deployed position.

FIG. 10 illustrates a second alternative embodiment, in which the compression spring 66 of the preferred embodiment is replaced by a tension spring 72. The tension spring 72 extends between and is attached to the bracing lift arm 58 and a rigid arm member 74 which extends between the upper ends of the mounting plates 16 and 18.

The various structural components of the assembly may be made of iron, aluminum or conventional stock, or may be made of polymeric stock to render the assembly lighter and easier to deploy and transport.

It will be appreciated that the preferred and alternative embodiments described above are illustrative only and are described for the purpose of enabling one of ordinary skill in the art to make and use the invention. Various modifications, substitutions, and alterations may be apparent to one of ordinary skill in the art, and such may be made without departing from the essential spirit of the invention. Accordingly, the scope of the patent protection claimed herein is defined only by the following claims.

The embodiments of the invention in which patent protection is claimed are as follows:

1. A portable, collapsible basketball backboard assembly comprising a generally flat base having front and rear edges, flat stabilizer means extending outwardly from said front edge of said base, support arm means having a lower end and an upper end, said lower end of said support arm means being hinged for swinging motion in a substantially vertical plane to said front edge of said base, a goal post having upper and lower ends, said lower end of said goal post being hinged to said upper end of said support arm means, a basketball backboard being affixed to said goal post, a bracing lift arm having upper and lower ends, said lower end of said bracing lift arm being hinged to said rear edge of said base, said upper end of said bracing lift arm being pivotably attached to said goal post at an intermediate point between said upper and lower ends of said goal posts, whereby said support arm means supports said goal post substantially vertically when said assembly is in an upright deployed position, and whereby said support arm means, goal post, and bracing lift arm may be folded downwardly from said upright deployed position to a compact folded position for storage.

2. The portable, collapsible basketball backboard assembly defined in claim 1 wherein said support arm means includes a pair of support arms each having upper and lower ends, and wherein said lower ends of said support arms are hinged to opposite sides of said front edge of said base, and wherein said support arms are configured so as to converge at said upper ends such that both of said support arms effectively support said goal post.

3. The portable, collapsible basketball backboard assembly defined in claim 2 wherein said support arms each includes an integral ear, said ears of said support arms operating to straddle said lower end of said goal post, and wherein said ears and said lower end of said goal post include bores which are aligned when said assembly is in said upright position, whereby said goal post may be locked in a substantially vertical orientation by means of a locking pin inserted through said bores.

4. The portable, collapsible basketball backboard assembly defined in claim 1 further including a pair of mounting plates extending upwardly from opposite ends of said rear edge of said base, each of said mounting plates including a pair of caster wheel assemblies extending rearwardly from said mounting plates, whereby said backboard assembly, when folded into said folded position, may be tilted rearwardly onto said caster wheel assemblies for transport.

5. The portable, collapsible basketball backboard assembly defined in claim 4 further including a rigid member extending between said mounting plates, and a tension spring extending between said rigid member and an intermediate point on said bracing lift arm, whereby said bracing lift arm is urged away from said base toward an upright position.

6. The portable, collapsible basketball backboard assembly defined in claim 1 wherein said bracing lift arm is spring biased by means of a compression spring extending between said base and an intermediate point on said bracing lift arm, whereby said bracing lift arm is urged away from said base toward an upright position.

7. The portable, collapsible basketball backboard assembly defined in claim 1 wherein said backboard is affixed to a support arm, said support arm including a tubular sleeve enclosing said goal post, said goal post having a plurality of bores passing therethrough, said sleeve having a pair of bores passing therethrough which are alignable with said bores in said goal post, whereby said sleeve and said backboard may be selectively set at varying heights on said goal post.

8. The portable, collapsible basketball backboard assembly defined in claim 7 wherein said backboard includes a basketball hoop pivotably mounted thereto, whereby said hoop may be folded against said backboard during storage.

9. The portable, collapsible basketball backboard assembly defined in claim 1 wherein said flat stabilizer means includes a pair of flat stabilizer arms extending outwardly substantially horizontally from the opposite ends of said front edge of said base.

10. The portable, collapsible basketball backboard assembly defined in claim 1 wherein said flat stabilizer means includes a flat stabilizer plate extending outwardly substantially horizontally from said front edge of said base.

* * * * *